United States Patent [19]

Grande et al.

[11] Patent Number: 4,621,437

[45] Date of Patent: Nov. 11, 1986

[54] METHOD AND APPARATUS FOR DRYING A SOLID MATERIAL WETTED WITH A SOLVENT OR SOLVENT MIXTURE

[75] Inventors: Robert Grande; Cornelis J. de Kluizenaar, both of Weesp, Netherlands; Dietmar C. Naunapper; Karlheinz J. Wehrle, both of Binzen bei Lörrach, Fed. Rep. of Germany

[73] Assignees: Duphar International Research B.V., Netherlands; Glatt GmbH, Fed. Rep. of Germany

[21] Appl. No.: 680,835

[22] Filed: Dec. 12, 1984

[30] Foreign Application Priority Data

Dec. 19, 1983 [NL] Netherlands ..... 8304347
May 8, 1984 [NL] Netherlands ..... 8401463

[51] Int. Cl.[4] ..... F26B 3/12

[52] U.S. Cl. ..... 34/10; 34/15; 34/35; 34/77; 34/86; 34/27; 34/36; 34/57 R; 118/61; 427/372.2

[58] Field of Search ..... 34/77, 35, 86, 92, 27, 34/29, 32, 34, 15, 36, 37, 10, 57 R, 57 A; 159/48.1, 4.01; 118/58, 61; 427/372.2, 374.6

[56] References Cited

U.S. PATENT DOCUMENTS 3,212,197 10/1965 Crawford .
3,699,662 10/1972 Stephanoff .
4,185,397 1/1980 Hutzenlaub ..... 34/36
4,205,456 6/1980 Ayers et al. ..... 34/35
4,245,395 1/1981 Potter .
4,385,450 5/1983 Thomas et al. ..... 34/77

FOREIGN PATENT DOCUMENTS 2085310 4/1982 United Kingdom .

*Primary Examiner*—Larry I. Schwartz
*Attorney, Agent, or Firm*—Finnegan, Henderson, Farabow, Garrett & Dunner

[57] ABSTRACT

The invention relates to a method of drying a solid wetted with a solvent or solvent mixture by causing superheated vapour of the solvent or solvent mixture as a carrier medium to flow through the material to be dried in an evaporation room, the solvent or solvent mixture evaporating and being carried along with the carrier medium, and by then causing the evaporated solvent or solvent mixture to condense from the carrier medium, if desired after compression thereof, in a cooling device. During this drying process a sub-ambient pressure is provided in the evaporation room and the temperature in the evaporation room is controlled by adjusting the sub-ambient pressure, if desired, in combination with an additional temperature controlling means. The inventiona also relates to a device for using the above method.

21 Claims, 4 Drawing Figures

Figure 1:
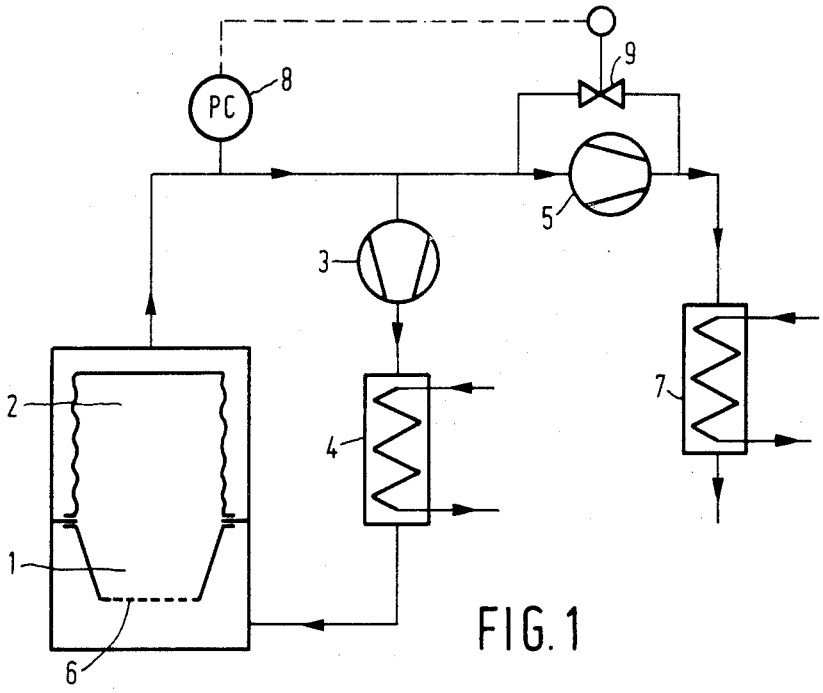

METHOD AND APPARATUS FOR DRYING A SOLID MATERIAL WETTED WITH A SOLVENT OR SOLVENT MIXTURE

The invention relates to a method of drying a solid. Drying may generally be considered to be a process in which liquid is removed from a solid by evaporation having for its objects to obtain a comparatively dry product. For the purpose of said evaporation, energy should be supplied, usually in the form of thermal energy.

In one of the manners of drying, sometimes termed direct drying, a heated gaseous medium, for example air or nitrogen, is used as an energy carrier. The thermal energy required for drying is withdrawn from the said medium, while the evaporated liquid is removed therewith. In this process, however, the liquid cannot easily be separated again from the medium and hence cannot easily be recovered.

The invention relates in particular to a method of drying a solid wetted with a solvent or solvent mixture by causing a carrier medium to flow through the material to be dried in an evaporation room, the solvent or solvent mixture evaporating and being carried along (entrained) with the carrier medium. Solvents are to be understood to mean organic solvents and water, in which, of course, the recovery of organic solvents is of particular importance.

Drying is extremely effective when the carrier medium is passed through the solid in particle form in such manner that the particles of the material to be dried are fluidised.

Such a "fluid-bed" drying process has been known for some time already and is used industrially on a large scale. In this known method a warm gas flow, for example air or nitrogen, is passed through the particles of the material to be dried in the evaporation room, the particles being kept in motion or fluidised ("fluidised-bed") by the gas flow.

The warm gas flow ensures the heat supply to the material to be dried, as a result of which solvent with which the material is wetted evaporates from the material and is carried along by the gas flow (carrier gas). By evaporation of the solvent the temperature in the evaporation room may decrease considerably.

If it should be desired to recover the solvent again from the carrier gas, the solvent charged with carrier gas may then be cooled, if desired after compression, so that the solvent can condense. The carrier gas flow depleted in solvent vapour may then, after heating again, be returned to the evaporation room. Such a drying process is described, for example, in Netherlands Patent Application No. 8104679 which corresponds to British Patent Application No. 2,085,310.

The above known method, however, in which an inert gaseous medium is used as a carrier for the solvent vapour has various disadvantages: The recovery of the solvent is impeded by the comparatively large quantity of carrier gas which has also to be cooled to cause the solvent to condense out. Recovery is more difficult with low boiling-point organic solvents, because cooling then has to be carried out down to a very low temperature to remove the solvent from the carrier gas to a satisfactory extent. When the carrier gas is emitted, it should, of course, be freed from solvent as completely as possible both from a point of view of environmental pollution and from a point of view of cost. But also when the carrier gas is returned to the evaporation room, it may usually comprise not more than a small content of solvent vapour in connection with reduced drying rates caused by lower mass transfer. Another likewise very important disadvantage is the comparatively high energy consumption. The cooling of the large quantity of carrier gas in order to cause the solvent to condense out requires very much energy. Futhermore, the heating of the carrier gas before it is introduced into the evaporation room also contributes to an increase of the energy consumption. The apparatus necessary to cool and to heat such large quantities is comparatively expensive. Finally, a pre-treatment of the carrier gas is often necessary to make it suitable for drying the moist material. For example, when drying hygroscopic materials the carrier gas must first be freed from water vapour before it can be used. This is the more important, since the temperature in the evaporation room during drying decreases so considerably.

In Netherlands Patent Application No. 8104679, the power supplied after cooling during expansion of the carrier gas is used for compression of the carrier gas charged with solvent, so as to reduce the energy consumption; this is reached by a mechanical coupling of expansion device and compressor. Althbugh in the process described in the said patent application the energy consumption is slightly restricted, it will be obvious that this method has great disadvantages, for example, the high costs of investment in connection with the complicated device.

In U.S. Pat. No. 4,245,395 the energy released during condensing the solvent vapour is used to heat the evaporation room externally. This will result in some energy saving, but it provides no real solution to the problems described.

The use of a carrier gas can be avoided by using, as is generally known, indirectly heated driers, for example, vacuum driers. In such driers the solvent is evaporated from the solid material by heating the evaporation room externally and generally providing a sub-ambient pressure in said room. However, when said indirect driers are used, the advantageous properties of fluid bed driers are lacking, namely the favourable influence of the carrier gas flow on the drying process. In the fluid bed drying process the heat and mass transfer are extremely good so that the material to be dried is dry in a very short period of time. Moreover, indirectly heated driers have only a restricted application, namely not for drying materials which cannot withstand the comparatively high drying temperature required in indirect drying, for example, temperature-sensitive substances or substances of which the particles start clotting together at higher temperature (agglomeration). In addition, indirectly heated dryers have a very restricted heat transfer.

When removing an organic solvent or a mixture of organic solvents from solid material, it is of importance that the organic solvents should be recovered as completely as possible. For environmental considerations it is not desired, often even not permitted by the authorities, to let organic solvents be emitted in the atmosphere. In addition, organic solvents are usually too expensive to be wasted.

More in particular the invention relates to a method of drying a solid which is wetted with a solvent mixture by using superheated vapour of said solvent or solvent mixture as a carrier medium. Such a method is described in U.S. Pat. No. 3,699,662. The process described is a continuous process whereby the solid to be dried is a pulverulent material which is fluidized during the drying process. The temperature of the superheated vapour is higher than the deterioration temperature of the material to be dried, but due to the endothermic character of the reaction this temperature almost instantly is lowered to below the deterioration point. This known process is carried out at high temperature of the carrier gas and substantially ambient pressure; in the example a pressure slightly greater than ambient is used.

The above-mentioned disadvantages occuring when an inert gaseous medium is used as a carrier for the solvent vapour are avoided by using the method as described in U.S. Pat. No. 3,699,662.

This known process, however, has the draw-back that it is not generally applicable for drying solids. Problems may occur in particular when these solids are temperature-sensitive substances or substances of which the particles tend to agglomerate a temperature. So in using the method from U.S. Pat. No. 3,699,662 the latter disadvantage mentioned above for the indirectly heated drying process is not excluded. As a matter of fact introduction of a carrier medium at a temperature higher than the deterioration point of the material to be dried does not exclude deterioration of some material in the very first phase of the drying process, so before the temperature of the carrier medium has been lowered by the endothermic drying process. Further, when there is a relatively small difference between the boiling point of the solvent to be evaporated and the deterioration point of the material to be dried, the process cannot be used without a substantial deterioration of the temperature-sensitive material during the drying process. Moreover, in the final phase of the drying process the endothermic character of the reaction gets lost, due to a reduced quantity of solvent remaining on the solid material to be dried. As a result of this the temperature in the evaporation room may rise undesirably, while the solvent has not completely been removed from the solid material.

The same method as described in U.S. Pat. No. 3,699,662 was disclosed earlier in U.S. Pat. No. 3,212,197. The above disadvantages of the process known from the former U.S. patent therefore equally apply for the process of the latter U.S. patent.

It is the object of the invention to provide a method of drying a solid which is wetted with a solvent or solvent mixture at such a low temperature as is desired for the material to be dried in connection with the properties thereof, and, in combination therewith, to allow an easy recovery of the solvent or solvent mixture, both under energy-saving conditions.

According to the invention, this object can be achieved by causing superheated vapour of said solvent or solvent mixture as a carrier medium to flow through the material to be dried in an evaporation room or chamber, said solvent or solvent mixture evaporating and being carried along with the carrier medium, and by then causing the evaporated solvent or solvent mixture to condense from the carrier medium, if desired after compression thereof, in a cooling device, during which drying process a sub-ambient pressure is provided in the evaporation room. The solvent vapour to be used as a carrier medium needs in this case be heated only to a temperature above the boiling-point of the solvent or solvent mixture at the sub-ambient or reduced pressure adjusted. It has been found, that by performing the drying process at a reduced pressure the temperature in the evaporation room can be controlled by a correct adjustment of the sub-ambient pressure only. However, if desired, said temperature control in the evaporation room may also be achieved by adjusting the sub-ambient pressure in combination with an additional temperature controlling means, e.g. by controlling the capacity of the heater. Therefore in using the method of the invention it is very easy to control the temperature in the evaporation room and so to avoid deterioration of the material to be dried. It has further been found that at a reduced pressure the drying process is very fast.

Although the method according to the invention also comprises other direct drying methods, it is particularly suitable for the fluid-bed drying process mentioned hereinbefore. It has been found that the drying process according to the invention runs off rapidly and efficaciously, which means that the superheated solvent vapour causes the solvent or solvent mixture to evaporate efficiently from the material to be dried, even at the desired low temperature prevailing in the evaporation room, and to take it along. It is generally known in the art, that in a fluid-bed drying process a great amount (mass) of carrier medium is required to obtain a sufficient fluidising of the solid and consequently a fast drying thereof. In view of this it is indeed beyond all expectation, that a very fast and efficacious drying of the solid under fluid-bed conditions can be obtained by using the method of the invention, viz. by adjusting a sub-ambient pressure in the evaporation room during the drying process. Although the method according to the invention has proved to be excellently suitable for drying under fluid-bed conditions, the method is not restricted hereto. Suitable fixed-bed drying processes wherein the method of the invention can be used are the regeneration or recovering of column packing material, for example in the column itself, and the evaporation of solvents from biological cultures which are naturally very heat-sensitive. As an example of column packing recovery is to be considered the removal of liquid contaminates from column packing material, e.g. an adsorbent like charcoal, making use of the favourable desorption conditions at low pressure.

The method of the invention can be used efficaciously when a considerably reduced pressure is applied, viz. preferably lower then approximately 50 kPa. Even at reduced pressures down the approx. 10 kPa a very fast drying under fluid-bed conditions could be obtained.

As a particular aspect of the invention it has been found, that preceding or during the method of drying a solid according to the invention, said solid very conveniently can be subjected to a processing operation by spraying a liquid or by both spraying a liquid and adding a pulverulent substance into the evaporation room.

For example, if the solid to be dried is a powder, fluid bed agglomeration processes, which are known as granulation and instantizing, where powder materials are wetted with binder solutions or solvents within the chamber of treatment or evaporation room, can be carried out. These procedures which require a controlled product bed moisture have the same practical importance as drying. Another important kind of processes which finally lead to drying but are started by wetting (like agglomeration) are the coating operations under fluidized bed conditions. In case the solid is in the form of cores, pellets, tablets or other shaped articles, these articles can be coated by means of varnishes, paints etc., which often are brought in by spraying or dropping in form of solutions. Another suitable example of a processing operation to be used preceding or during the drying process is the formation of pellets by build-up of preformed particles, e.g. crystals, where powders in the form of suspensions are fed to the preforms or a binder solution is brought on both powder and preforms to achieve a layer built up on the preforms. Similar to fluidized bed processes which were mentioned as pellet formation and filmcoating are coating processes on rotating disks, where the functions of particle movement and drying by evaporation are separated to a certain degree. The gas circulation of solvent vapour will be advantageous here also for effective drying. If desired, in the last phase of the drying process, viz. when the bulk of the solvent or solvent mixture has been evaporated from the solid, a suitable amount of an inert gas may be added to obtain a substantially solvent-free product.

It will be obvious that the method according to the invention can be used both batchwise and continuously. In the latter case it should be ensured that a Well closed dosing and discharge system for the material to be dried is available.

The method according to the invention is, of course excellently suitable for recycling the solvents, which means that a part of the solvent vapour is heated again and is returned to the evaporation room and only the remaining part of the evaporated solvent is condensed by cooling. This process can be repeated until the solid has been freed from solvent as well as possible, hence is sufficiently dry. If desired, the solvent, whether or not after condensation, may first be subjected to a treatment, for example, a purification, before it is returned in vapour form to the evaporation room. The process according to the invention can energetically be carried out very advantageously by using the energy delivered in the cooling device during condensation of the evaporated solvent or solvent mixture for heating the carrier medium. In this manner, evaporation energy and condensation energy need in principle not be supplied and dissipated.

The invention also relates to apparatus for using the methods described hereinbefore. The apparatus according to the invention comprises a circuit for the carrier medium. In this circuit are connected an evaporation room in which the carrier medium is charged with solvent vapour from the material to be dried and in which are provided, if desired, one or more filters, a fan and/or compressor, and a heating device for the carrier medium. The heating device should be adapted to heat the vapour of the solvent or solvent mixture to be used as a carrier medium to above the boiling-point at the applied sub-ambient pressure. The device further comprises a cooling device for condensing the solvent or solvent mixture. In order to be able to perform the method according to the invention at a considerably reduced pressure, the device according to the invention comprises a vacuum pump. By means of this vacuum pump the sub-ambient pressure can be adjusted so that an excellent temperature control can be achieved in the device. Said cooling device can be positioned before or after the vacuum pump. If desired a temperature controlling means can be put in the circuit, to allow an additional control of the temperature in the evaporation room.

The cooling device and the heating device which are constructed, for example, as heat exchangers, are preferably coupled energetically so that the energy taken up by the cooling medium in the cooling device can be used for heating the carrier medium in the heating device. Said coupling preferably includes a means to allow the cooling or heating medium to circulate through cooling device and heating device. As an alternative preferred energetical coupling, said last devices may be combined to a single heat exchanger to allow a direct heating of the carrier medium by the energy delivered by the condensed solvent vapour.

The invention further relates to apparatus suitable for carrying out both the processing operation and the drying process. For this purpose, the evaporation room is provided with at least one liquid adding device or both at least one liquid adding device and at least one powder dosing device, each device being connected with a reservoir outside the evaporation room. If the solid or solid particles need to be moved during processing, it may be of advantage that in the drying/processing devices the evaporation room comprises at least one means for achieving a directed motion of the solid material. Suitable means therefore include a vertically or horizontally acting agitator or stirrer in order to achieve a steady motion of the solid, or a horizontal rotary disk in order to allow the solid to perform an inwardly directed circular motion, or a vertically oriented partition tube in order to allow the solid to perform an outwardly directed circular motion.

The invention will now be described in greater detail with reference to various embodiments of the device according to the invention which are shown in the drawings, and will be illustrated with the following examples.

Figure 2:
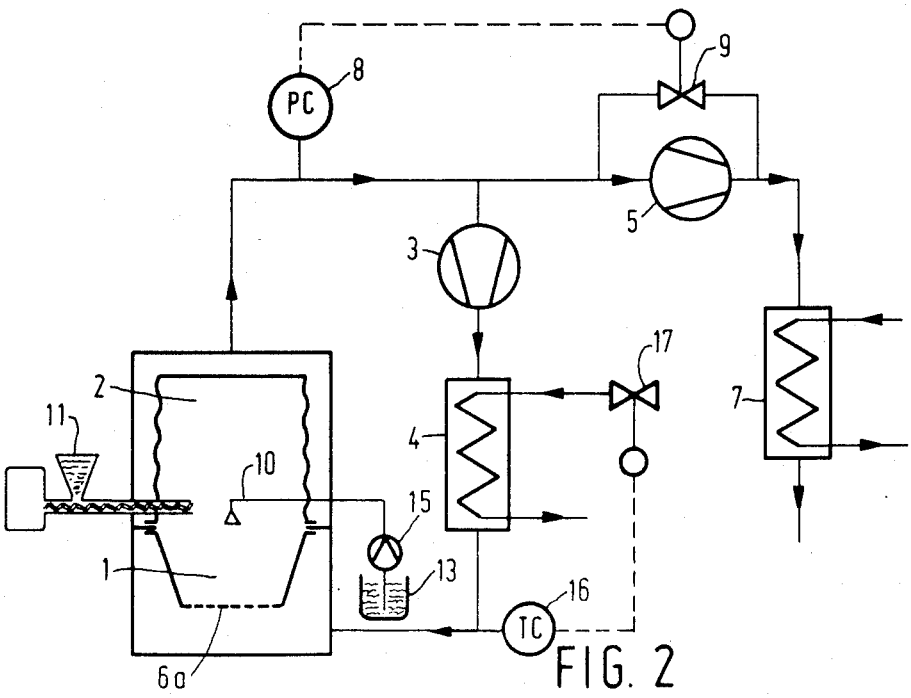
Figure 3:
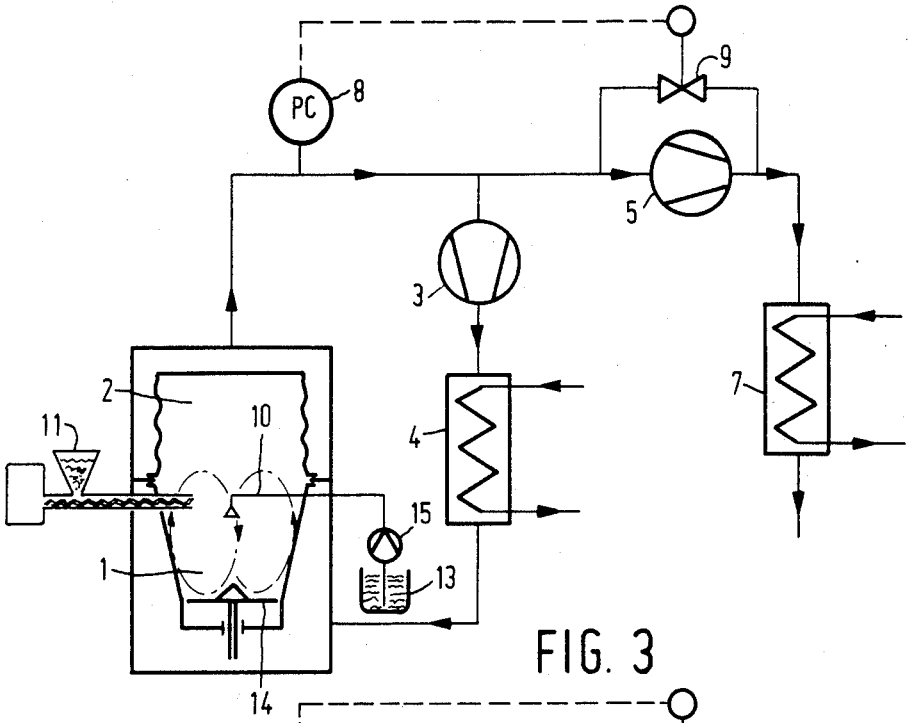
Figure 4:
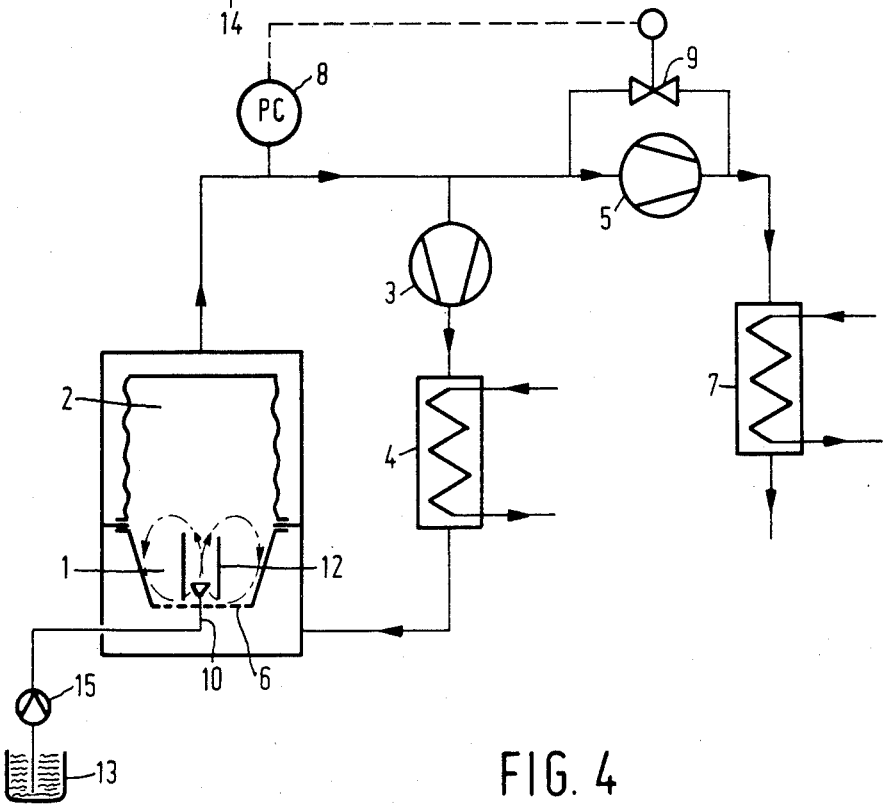

FIG. 1 is a diagram of one embodiment of the apparatus and process for drying a solid material according to the present invention; and FIGS. 2–4 are diagrams of further embodiments of the apparatus and process of the invention for the processing or treatment of a solid material in addition to the drying thereof.

FIG. 1 shows diagrammatically a circuit for drying a solid by means of superheated solvent vapour as a carrier medium, in which circuit are connected an evaporation room 1 having two filters 2 and 6, a fan 3 and a heatable heat exchanger 4. The circuit is brought at a reduced pressure by means of a vacuum pump 5. The device further comprises a cooling device 7 for condensing solvent or a mixture of solvents. The evaporation room is constructed so that the solid present therein can fluidise under the influence of the superheated solvent vapour led through by means of the fan. During operation of the device the temperature in the evaporation room is controlled by adjusting the applied sub-ambient pressure. Said pressure control and temperature adjustment are made possible by a coupling between pressure control device 8 and control valve 9.

FIGS. 2, 3 and 4 show diagrammatically additional circuits for carrying out both a processing operation or treatment of the solid material and a drying process. For this purpose the devices shown have in addition to the components already defined above one or more liquid and/or powder adding devices and optionally means for effecting a motion of the solid material. In FIGS. 2, 3 and 4 a spray nozzle for e.g. agglomerating and coating purposes is indicated with reference numeral 10. The spray nozzle is connected via a pump 15 with a liquid reservoir 13 outside the evaporation room. Reference numeral 11 in FIGS. 2 and 3 denotes a powder dosing device, having an outlet within the evaporation room and a powder reservoir outside. The lower filter *6a* is adapted to allow the desired processing operations. In FIG. 3 in addition a rotating disk 14 is positioned just above the lower filter or instead of the lower filter in order to allow the solid to perform an inwardly directed circular motion. In FIG. 4 is in place of said disk a partition tube 12 vertically positioned on the lower filter, the spray nozzle 10 debouching within the partition tube. Said partition tube allows the solid to perform an outwardly directed circular motion. Further in FIG. 2 an additional temperature controlling means has been put in the circuit, to allow an additional control of the temperature of the carrier medium flowing in the evaporation room. This temperature controlling means functions as a heater capacity control and includes a temperature control device 16 and a control valve 17.

EXAMPLE I: drying of lecithin granules

Lecithin granules wetted With acetone (acetone content approximately 50%) were dried in the above-described device, shown in FIG. 1. For that purpose the granules were provided in the evaporation room between the two filters, after which the whole circuit including the evaporation room was brought at a reduced pressure between 10 and 20 kPa by means of the vacuum pump. At the applied sub-ambient pressure, superheated acetone vapour, i.e. acetone vapour which has been brought at a temperature of approximately 70° C. by the heat exchanger, was then led through the lecithin granules by means of the fan for approximately 3 minutes. The acetone separated from the lecithin granules was condensed by means of the cooling device 7. After approximately 3 minutes the lecithin granules were dry, i.e. contained less than 0.5% acetone. During drying, the temperature in the fluid bed (evaporation room) has dropped to below 10° C.

EXAMPLE II: regeneration of charcoal granules

According to the described method active charcoal granules were regenerated. In place of the evaporation room a bed of the granules charged with acetone was placed in the circuit of FIG. 1. By means of the vacuum pump the circuit was brought at a reduced pressure between 10 and 20 kPa. The acetone vapour was recirculated at the applied sub-ambient pressure, heated to 80°-100° C. in the heat exchanger 4, and subsequently passed through the bed of the coal granules. The acetone desorbed from the coal was removed from the circuit and condensed.

EXAMPLE III: Granulation of hydrophilic powder, (acetylacetate effervescent powder)

A dry powder mixture as defined above was filled in the evaporation room 1 of the device shown in FIG. 2 between the two filters. The system pressure has been reduced to a pressure of 10 up to 50 kPa in order to evaporate all water residuals. At the applied pressure the fan 3 starts blowing, and wetting is started by spraying on the powder mixture at 10 an isopropanol mist, which condensates on the particles and allows surface binding strength to develop. When a certain moisture degree in the bed is achieved the temperature of the returning gas is increased slowly adapting the sub-ambient pressure, and spraying is stopped. Then a drying process similar to that described in Example I follows.

EXAMPLE IV: Sugar Crystal Pellet Formation

Sugar crystals in sizes between 0.1 and 0.5 mm were filled in the evaporation room 1 of the device, shown in FIG. 3. The system pressure has been reduced to 30 up to 50 kPa while fan 3 was started. A solution of aceton-polyvinylpyrolidone is sprayed at 10 on the slightly and gentle fluidized or spirally moved product bed while additional coating powder, i.e. starch, is dosed (11) precisely on the wetted bed. The system pressure is to be decreased with increasing product bed moisture in order to stabilize the layer conditions. The sub-ambient pressure of the system also serves to control the temperature of the fluid-bed. When the desired degree of layer built up has been achieved, the spraying and the powder dosing are finished and the system pressure is reduced for the final drying process which in principle is similar to that described in Example I.

EXAMPLE V: Tablet Film Coating

Tablet film coating is performed in a device which is shown in FIG. 4. Evaporation room 1 not only serves to allow evaporation of the solvent from the solid material but also allows different particle motions, as there are the tablet guiding stream motion, initiated by partition tube 12. Tablets are filled in zone 1 and all attached fine particle dust is removed by fluidizing or bed movements under air suspension. Then the system pressure is reduced down to 5 up to 15 kPa and the spray nozzle 10 is opened, allowing a varnish/solvent-solution to be sprayed over the moving tablet bed. At contant pressure all required varnish is deposited and then a drying process similar to that described in Example I follows. During the drying process the system pressure drops to the final value.

We claim:

1. A method of drying a solid material wetted with a solvent or solvent mixture, wherein said material is in particulate form, comprising providing said wetted material in an evaporation chamber, providing a subatmospheric pressure in said evaporation chamber and adjusting said subatmospheric pressure to control the temperature in said evaporation chamber, flowing a superheated vapor of said solvent or solvent mixture as a carrier medium through said material in said evaporation chamber to evaporate said solvent or solvent mixture and carry said evaporated solvent or solvent mixture along with said carrier medium, and condensing said evaporated solvent or solvent mixture from said carrier medium in a cooling apparatus, wherein said step of flowing said vapor through said material fluidizes said material.

2. A method according to claim 1, wehrein said subatmospheric pressure is lower than about 50 kPa.

3. A method according to claim 1, further comprising spraying said material with a liquid in said evaporation chamber.

4. A method according to claim 1, further comprising adding a pulverulent substance to said material in said evaporation chamber.

5. A method according to claim 3, further comprising adding a pulverulent substance to said material in said evaporation chamber.

6. A method according to claim 3, wherein said material is a powder, said liquid comprises at least one solvent or solution, and said spraying causes said powder to agglomerate or instantize.

7. A method according to claim 3, wherein said material is in the form of tablets, cores, pellets, or other shaped articles, wherein said liquid comprises at least one solution of at least one coating forming substance, and wherein said spraying coats said material.

8. A method according to claim 4, wherein said material is in the form of preformed particles, said pulverulent substance comprises at least one powder suspension, and said adding causes a layer of said powder suspension to build up on said preformed particles.

9. A method according to claim 5, wherein said material is in the form of preformed particles, said pulverulent substance comprises at least one powder suspension, said liquid comprises at least one binder solution, and said spraying and adding cause a layer to build up on said preformed particles.

10. An apparatus for drying, under fluidized conditions, a solid material, in particulate form, wetted with a solvent or solvent mixture, utilizing a superheated vapor of said solvent or solvent mixture as a carrier medium, said apparatus comprising:

(a) evaporation chamber means for containing said particulate material to be dried;

(b) vacuum pump means operatively connected to said evaporation chamber for reducing the pressure in said evaporation chamber means to a selected subatmospheric pressure;

(c) pressure control means operatively connected to said vacuum pump means to maintain the pressure in said evaporation chamber means to said selected subatmospheric pressure;

(d) circulating means in communication with said evaporation chamber means for flowing said carrier medium through said particulate material while said particulate material is in said evaporation chamber means to bring said paritculate material into a fluidized condition;

(e) heating means connected to said evaporation chamber means for heating said carrier medium prior to entry to said evaporation chamber means; and (f) cooling means operating connected to said vacuum pump means for condensing evaporated solvent or solvent mixture in said carrier medium received from said evaporation chamber means.

11. An apparatus according to claim 10, wherein said circulating means is a fan.

12. An apparatus according to claim 10, wherein said circulating means is a compressor.

13. An apparatus according to claim 10, further comprising temperature controlling means for controlling the temperature in said evaporation chamber means.

14. An apparatus according to claim 10, further comprising means for circulating a cooling or heating medium through both of said heating means and said cooling means, whereby the energy delivered in said cooling means during condensation is used in said heating means for heating said carrier medium.

15. An apparatus according to claim 10, wherein said heating means and said cooling means constitute a single heat exchanger means for directly heating said carrier medium with energy delivered by said condensation of said evaporated solvent or solvent mixture.

16. An apparatus according to claim 10, further comprising at least one means for applying at least one liquid to said material in said evaporation chamber means, and reservoir means outside said evaporation chamber means for supplying said liquid applying means.

17. An apparatus according to claim 16, further comprising at least one means for applying a powder to said material in said evaporation chamber means, and reservoir means outside said evaporation chamber means for supplying said powder applying means.

18. An apparatus according to claim 10, further comprising at least one means for moving said material in said evaporation chamber means in a predetermined pattern.

19. An apparatus according to claim 18, wherein said moving means is a vertically or horizontally acting agitator or stirrer means for causing a steady motion of said material.

20. An apparatus according to claim 18, wherein said moving means is a horizontal rotary disc means for moving said material in an inwardly directed circular pattern.

21. An apparatus according to claim 18, wherein said moving means is a vertically oriented partition tube means for moving said material in an outwardly directed circular pattern.

* * * * *